US008061061B1

(12) United States Patent
Rivas

(10) Patent No.: US 8,061,061 B1
(45) Date of Patent: Nov. 22, 2011

(54) COMBINED FOOTWEAR AND ASSOCIATED FASTENING ACCESSORY

(76) Inventor: Rogue Rivas, Clearwater, FL (US)

( * ) Notice: Subject to any disclaimer, the term of this patent is extended or adjusted under 35 U.S.C. 154(b) by 467 days.

(21) Appl. No.: 12/380,251

(22) Filed: Feb. 25, 2009

(51) Int. Cl.
*A43C 11/20* (2006.01)

(52) U.S. Cl. ..... 36/50.1; 36/51; 36/54; 36/137; 24/68 SK

(58) Field of Classification Search ..... 36/50.1, 36/50.5, 51, 54, 137; 24/68 SK
See application file for complete search history.

(56) References Cited

U.S. PATENT DOCUMENTS 3,808,644 A * 5/1974 Schoch ..... 24/68 SK
5,117,567 A * 6/1992 Berger ..... 36/50.1
5,177,882 A * 1/1993 Berger ..... 36/50.1
5,327,662 A * 7/1994 Hallenbeck ..... 36/50.1
5,463,822 A * 11/1995 Miller ..... 36/50.1
5,502,902 A * 4/1996 Sussmann ..... 36/50.1
5,737,854 A * 4/1998 Sussmann ..... 36/50.1
6,267,390 B1 * 7/2001 Maravetz et al. ..... 280/14.21
6,289,609 B1 9/2001 Bowen
6,324,774 B1 12/2001 Zebe, Jr.
6,416,074 B1 * 7/2002 Maravetz et al. ..... 280/624
7,036,193 B1 5/2006 Liu
7,946,061 B2 * 5/2011 Holzer et al. ..... 36/50.5

* cited by examiner

*Primary Examiner* — Ted Kavanaugh

(57) ABSTRACT

A combined footwear and associated fastening accessory for use therewith may include footwear with a tongue, a plurality of apertures, and a fastening accessory removably coupled to the footwear. The accessory may include a housing removably seated directly on the tongue. A plurality of deformably resilient elastic arms may be coupled to the housing and radially extended from the housing. The arms may include fasteners terminating at corresponding apertures and removably connected thereto, such that the housing may remain centrally aligned on the tongue and prohibited from becoming disengaged. Also, a mechanism may be included for selectively adjusting tension in each of the arms by rotating the housing along clockwise and counter-clockwise directions, while maintaining the fasteners directly connected to the apertures. Further, a mechanism for illuminating the housing when the top cap is in a raised position may be included and may illuminate the housing during walking conditions.

19 Claims, 9 Drawing Sheets

COMBINED FOOTWEAR AND ASSOCIATED FASTENING ACCESSORY

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to illuminable footwear shoelace accessories and, more particularly, to a combined footwear and associated fastening accessory for use therewith.

2. Prior Art

A shoe usually includes a pair of eyelet tabs and a shoelace. Each of the eyelet tabs is formed with a plurality of eyelets. The shoelace is typically strung through the eyelets to form a criss-cross pattern on the eyelet tabs, and is then tied into a knot so as to tighten the shoe. However, it is time-wasting to tie and untie the shoelace when wearing and removing the shoe. Many shoe lacing systems have been designed to provide a faster and more convenient way of securing a shoe onto the foot.

The vast majority of these systems are "lace closure systems" which accomplish this task in part by means of a lace or pliable fiber through which tension is applied. Problems inherent in lace closure systems includes unwanted tightening of knots caused by tension in laces occurring through everyday use of shoe, and weakening and eventual breakage of lace at points where the lace rubs against eyelets of the shoe. Lace closure systems are also impractical and undesirable for use by persons with rheumatoid arthritis, or persons with weight problems, or injuries which make it difficult for them to bend over for the period of time required to perform lace closure.

U.S. Pat. No. 6,289,609 to Bowen discloses a fastening device comprising an actuating lever rotatably secured to one flap of a shoe and a tie element extending substantially in alignment therewith. Further, a substantially planar undersurface with a series of hook elements is included and projects therefrom. Any of the hook elements are engageable with a catch element secured to the opposing flap of shoe. Another version of the device has a tie element comprising a substantially planar and rectangular component defining a series of rung like members where each rung like member is engageable to the catch element. Unfortunately, this prior art reference does not disclose a centrally located lighted disc to provide a fashionable accessory.

U.S. Pat. No. 6,324,774 to Zebe Jr. discloses a retaining clip for holding shoelaces and replacing standard footwear eyelets including one integral member formed with a base attached to the shoe upper with a curved member extending upwardly therefrom and an upper member extending back across the base. An abutment member extends outwardly from the upper member toward the base member to be in abutment therewith for retaining a shoelace there within and a prying tab extends upwardly from the abutment member.

The shoelace, when urged against the prying tab, will cause the abutment member to separate from the base allowing the shoelace to snap into place. When the shoelace is pulled against the opposite side of the abutment member, release is achieved. The footwear construction includes a shoelace securing means having a cam cleat for firm gripping of the shoelaces and facilitating extremely rapid operation of the overall footwear closure construction. Unfortunately, this prior art reference does not disclose a non-laced method of keeping the shoe panels intact.

U.S. Pat. No. 7,036,193 to Liu discloses a shoe tightening device for use with a shoe that includes a pair of eyelet tabs each having eyelets. The shoe tightening device includes a pair of lace units, a clamp unit, and a pull lace. Each of the lace units includes connecting end portions, operating end portions, intermediate portions, and anchoring elements adapted to be anchored removably on the eyelet tabs at corresponding ones of the eyelets. The clamp unit removably clamps at least one of the lace units, and includes at least one flexible string section, and at least one clamp member. The clamp member is slidable along the flexible string section between a clamping position and a releasing position. The pull lace is connected to the flexible string section for pulling the flexible string section so that the clamp member can slide along the flexible string section to the releasing position. Unfortunately, this prior art reference also does not disclose a non-laced method for keeping the shoe panels intact, nor does it feature a centrally located lighted disc.

Accordingly, a need remains for a combined footwear and associated fastening accessory in order to overcome the above-noted shortcomings. The present invention satisfies such a need by providing a device that is convenient and easy to use, is durable yet lightweight in design, is versatile in its applications, and provides an alternative for shoelaces and a creative outlet for expression through fashion.

BRIEF SUMMARY OF THE INVENTION

In view of the foregoing background, it is therefore an object of the present invention to provide a device for providing an alternative to shoe laces and a creative outlet for expression through fashion. These and other objects, features, and advantages of the invention are provided by a combined footwear and associated fastening accessory.

A combined footwear and associated fastening accessory for use therewith may include footwear with a tongue, a plurality of apertures adjacent to the tongue, and a fastening accessory removably coupled to the footwear. The fastening accessory may include a housing that may be removably seated directly on the tongue and also may remain intermediately spaced between the apertures.

Further, a plurality of deformably resilient elastic arms may be coupled to the housing and radially extended away from a center of the housing. The arms may terminate at corresponding apertures respectively. A plurality of fasteners may be directly mated to distal ends of the arms respectively. In addition, the fasteners may be removably connected to the apertures such that the housing may remain centrally aligned on the tongue and thereby prohibited from disengaging the tongue during walking conditions.

Also, a mechanism may be included for selectively adjusting the tension in each of the arms by rotating the housing along clockwise and counter clockwise directions while maintaining the fasteners directly connected to the apertures. The mechanism provides the unpredictable and unexpected benefit of allowing the user to tighten the footwear around their foot by simply rotating the housing, a feature not rendered obvious by one skilled in the art.

The housing may further include an annular base member that may preferably have a raised outer wall extending along an entire circumference of the base member. The base member further may have a planar bottom surface recessed from a top edge of the outer wall and concentrically seated at a bottom edge of the outer wall. In this manner, a cavity may be formed above the bottom surface and between the outer surface respectively. The housing may also include a top cap dynamically situated within the cavity and centrally aligned above the bottom surface.

The housing may additionally feature a deformably resilient spring member preferably having axially opposed top and bottom ends directly engaged to an underside of the top cap and the bottom surface of the base member respectively. This may operate such that the spring member may remain permanently intercalated between the top cap and the base member during tension adjusting procedures.

The top end of the spring member may be dynamically abutted against the top cap while the bottom end of the spring member may be statically coupled to the bottom surface of the base member. In this manner, the top cap may freely rotate along the top end of the spring member during the tension adjusting procedures. In addition, the base member preferably remains statically situated on the tongue during the tension adjusting procedures. This is advantageous because it may prevent the base member from being pulled in any one direction when the user rotates the cap to add tension to the arms and thereby tighten the footwear to the desired fit.

The tension adjusting mechanism may further include a plurality of fingers that may be statically and directly coupled to the top cap. The fingers may radially protrude outwardly and away from an outermost perimeter of the top cap and may terminate inwardly of the outer surface of the base member. A plurality of notches may be formed in an inner wall of the outer surface and may be configured in such a manner that the notches may receive the fingers therein when the spring member and the top cap are at corresponding equilibrium and raised positions respectively.

The fingers may be disengaged from the notches when the top cap and the spring member are contemporaneously displaced downward along a linear travel path defined orthogonal to the bottom surface of the base member. Further, the top cap may be prohibited from rotating along the clockwise and counter clockwise directions when the top cap is situated at the raised position.

Additionally, the top cap may be permitted to rotate along clockwise and counter clockwise directions after the top cap is linearly displaced downwardly along the linear travel path and the spring member is compressed to a tensioned position. Therefore, to operate the mechanism, the user may simply depress the top cap, releasing the fingers from the notches to permit the cap to be rotated in either direction, thereby tightening or loosening the tension of the fasteners within the apertures. Upon reaching a desired tension, the user may release pressure on the cap and allow the spring member to return to equilibrium and the cap to the initial height with the fingers resting in alternate notches.

The combined footwear and associated fastening accessory may further include each of the arms having a proximal end penetrated through the outer surface of the base member and directly anchored to the top cap. The proximal ends may be downwardly displaced from a raised position when the fingers are downwardly displaced away from the notches such that the tension may increase in the arms. Further, the proximal ends of the arms may be rotatably displaced along the clockwise and counter clockwise directions after the top cap is downwardly displaced and rotated along the clockwise and counter clockwise directions.

In addition, the arms may be maintained at rotatably displaced positions and may thereby be locked at a tensioned position when the top cap is released to the raised position and the fingers re-engage the notches respectively. The tension of the arms may be increased when the proximal ends of the arms are shifted to the rotatably displaced positions and maintained within the housing respectively. Thus, by depressing the top cap and moving it along either direction, the user may advantageously adjust the tension of the arms and corresponding tightness of the shoe in relation to the user's foot, and thereby release the top to relock the fingers into the notches.

The combined footwear and associated fastening accessory may further include a mechanism for illuminating the housing when the top cap is disposed at the raised position such that the housing remains illuminated during walking conditions. Such a mechanism is vital and advantageous for providing a unique and attractive fashion accessory. Additionally, the illumination may be beneficial for safety purposes by warning drivers after dark that the user is walking along the road. The housing illuminating mechanism may include a power source and a light-emitting member seated within the housing. The mechanism may also include a first plurality of conductive contacts electrically coupled to the fingers and the power source respectively and a second plurality of conductive contacts electrically coupled to the notches and the light-emitting member respectively.

The second conductive contacts may be aligned with corresponding ones of the first conductive contacts when the top cap is released to the raised position and the fingers are situated into the corresponding notches respectively. Power may be transmitted from the power source to the light-emitting member when the top cap is released to the raised position and the spring member is adapted to the equilibrium position.

In this manner, when the top cap is in the raised position, electrical current is permitted to flow from the power source through the second plurality of conductive contacts to the first plurality of conductive contacts to the light-emitting member. This is advantageous in that the light may be illuminated at all times when the cap is in the raised position, thereby signaling to the user that the cap is not locked in place and the arms are not securely tensioned if the light is not illuminated.

The present invention may further include a method for employing a combined footwear and associated fastening accessory. Such a method may include the chronological steps of first providing footwear that preferably has a tongue and a plurality of apertures formed adjacent to the tongue respectively. Second, the method may include providing and removably coupling a fastening accessory to the footwear by performing a series of steps. The first step may entail providing and removably seating a housing directly onto the tongue by intermediately spacing the housing between the apertures.

A second step may include providing and coupling a plurality of deformably resilient elastic arms to the housing. A third step may include terminating arms of the accessory at corresponding ones of the apertures by radially extending the arms away from a center of the housing. A fourth step may include providing and mating a plurality of fasteners directly to distal ends of the arms respectively. Thereafter, a fifth step preferably includes prohibiting the housing from disengaging the tongue during walking conditions by removably connecting the fasteners to the apertures and maintaining the housing centrally aligned on the tongue. A final step may include selectively adjusting a tension in each of the arms by rotating the housing along clockwise and counter clockwise directions while maintaining the fasteners directly connected to the apertures. There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
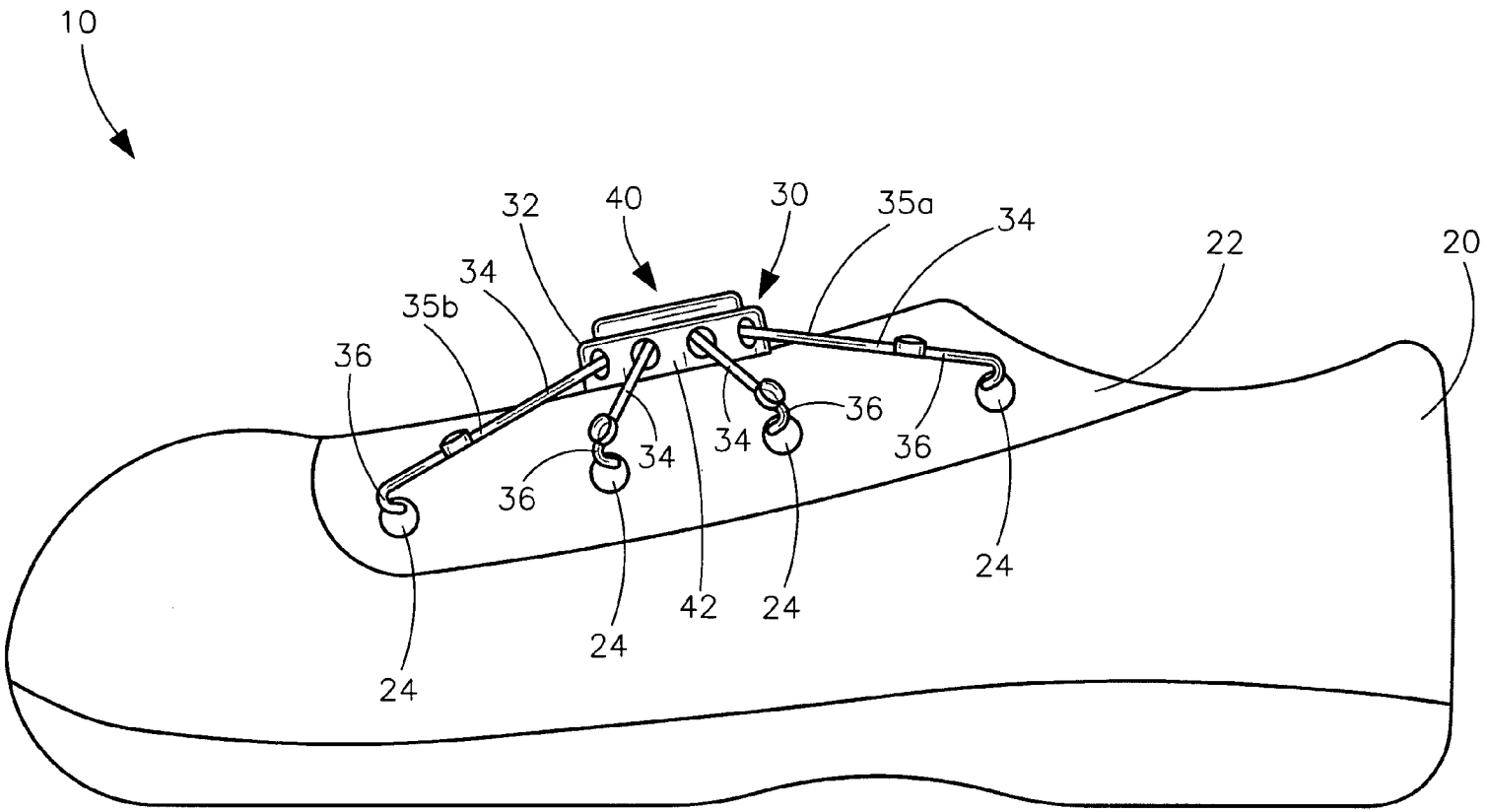
FIG. 1 is a side elevational view showing a combined footwear and associated fastening accessory, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-7 by the reference numeral 10 and is intended to provide a combined footwear and associated fastening accessory. It should be understood that the combined footwear and associated fastening accessory 10 may be used to fasten many different types and styles of footwear, including tennis shoes or boots, and should not be limited in use to the applications addressed herein.

Figure 2:
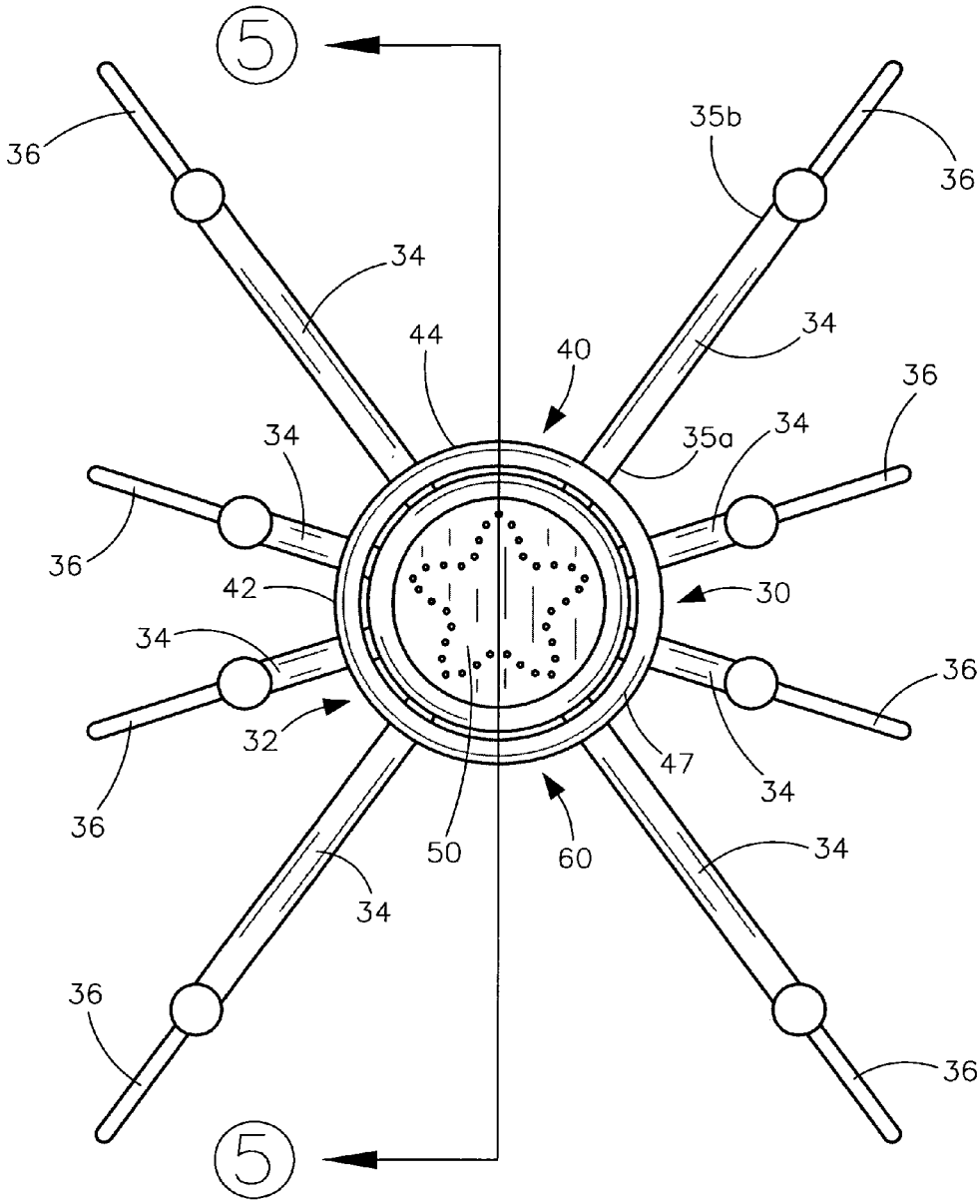
FIG. 2 is a top plan view of the associated fastening accessory shown in FIG. 1.
Figure 3:
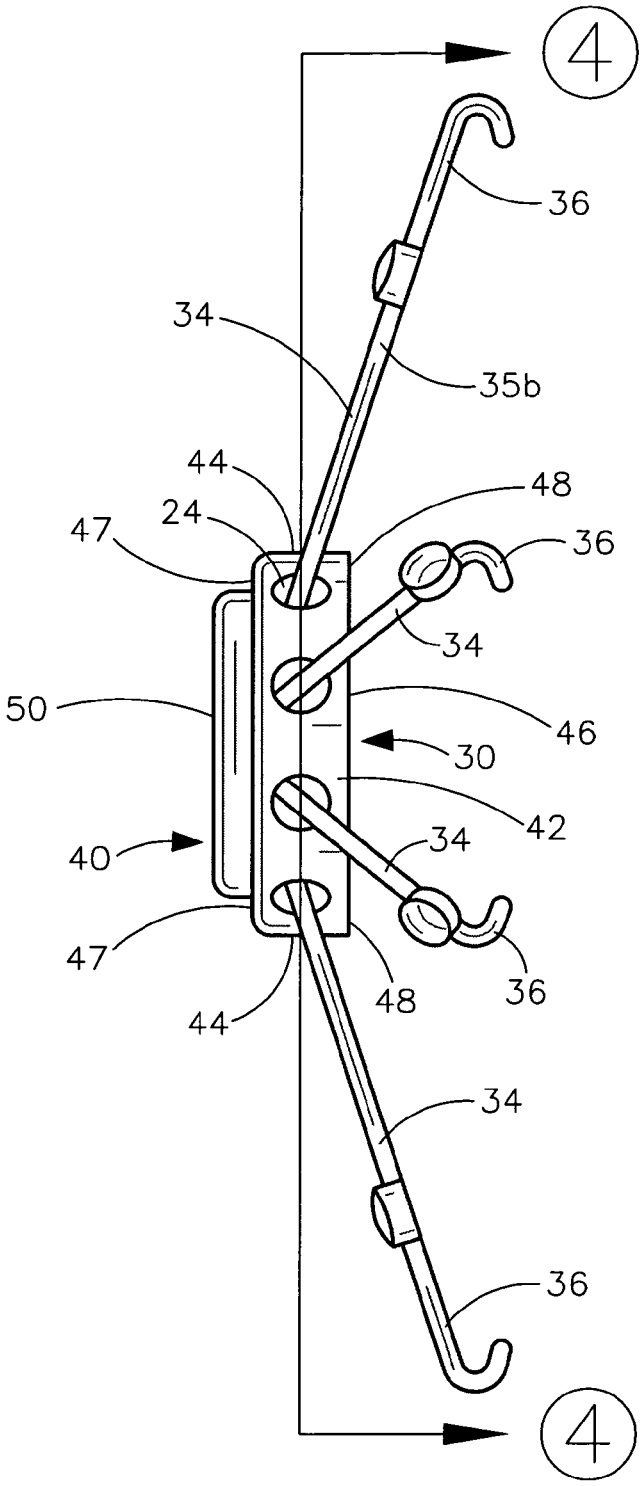
FIG. 3 is a side elevational view of the associated fastening accessory shown in FIG. 1.

Referring initially to FIGS. 1-3, a combined footwear and associated fastening accessory 10 for use therewith may include footwear 20 with a tongue 22, a plurality of apertures 24 adjacent to the tongue 22. The present invention further includes a fastening accessory 30 removably coupled to the footwear 20. The fastening accessory 30 may include a housing 32 that may be removably seated directly on the tongue 22 and also may remain intermediately spaced between the apertures 24.

Further, a plurality of deformably resilient elastic arms 34 may be coupled to the housing 32 and radially extended away from a center of the housing 32. In a preferred embodiment, the arms 34 may include conventional shoe laces, for example. The arms 34 may terminate at corresponding apertures 24 respectively. A plurality of fasteners 36 may be directly mated to distal ends 35B of the arms 34 respectively. In addition, the fasteners 36 may be removably connected to the apertures 24 such that the housing 32 may remain centrally aligned on the tongue 22 and thereby prohibited from disengaging the tongue 22 during walking conditions.

Also, a mechanism 40 may be included for selectively adjusting the tension in each of the arms 34 by rotating the housing 32 along clockwise and counter-clockwise directions while maintaining the fasteners 36 directly connected to the apertures 24. The mechanism 40 provides the unpredictable and unexpected benefit of allowing the user to tighten the footwear 20 around their foot by simply rotating the housing 32, a feature not rendered obvious by one skilled in the art.

Referring now to FIGS. 1-5*b*, the housing 32 may further include an annular base member 42 that may have a raised outer wall 44 extending along an entire circumference of the base member 42. The base member 42 further may have a planar bottom surface 46 recessed from a top edge 47 of the outer wall 44 and concentrically seated at a bottom edge 48 of the outer wall 44. In this manner, a cavity 49 may be formed above the bottom surface 46 and within the outer wall 44 respectively. The housing 32 may also include a top cap 50 dynamically situated within the cavity 49 and centrally aligned above the bottom surface 46.

Figure 5A:
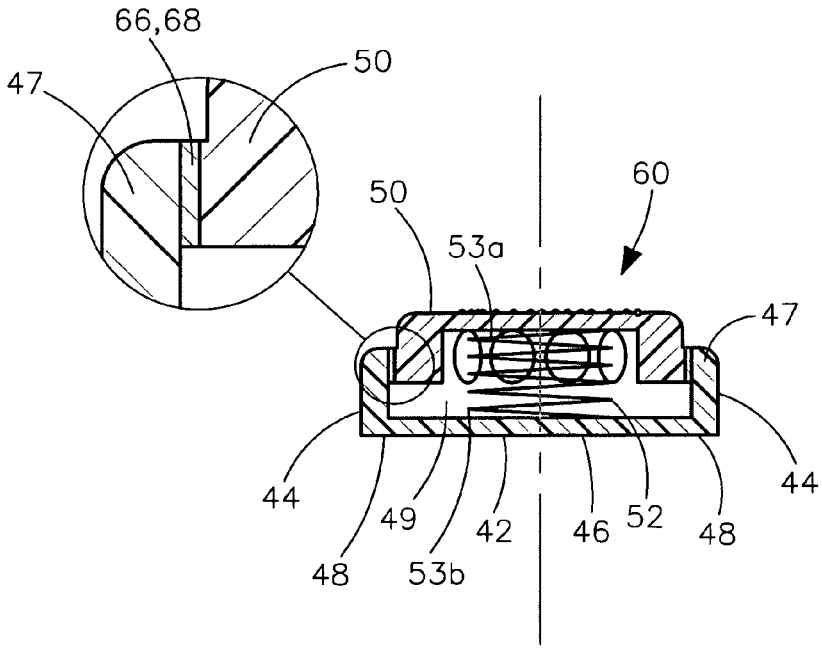
FIG. 5*a* is a cross sectional view of the housing shown in FIG. 2, taken along line 5-5, showing the cap and the spring member in the initial raised position with first and second conductive contacts engaged.
Figure 5B:
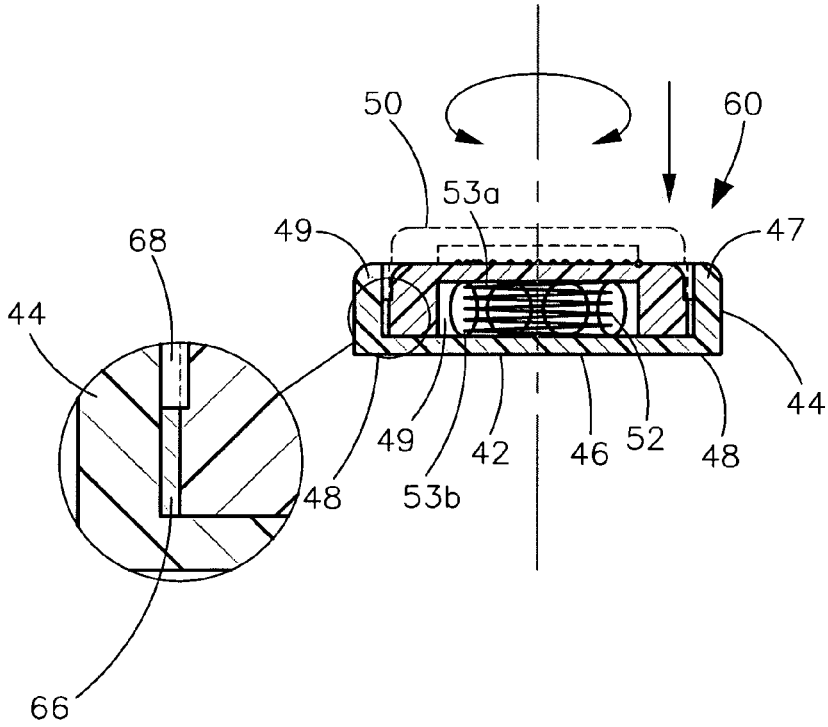
FIG. 5*b* is a cross sectional view of the housing shown in FIG. 2, taken along line 5-5, showing the cap and the spring member in the depressed lowered position with first and second conductive contacts disengaged.

Now referring to FIGS. 5*a* and 5*b*, the housing 32 may additionally feature a deformably resilient spring member 52 preferably having axially opposed top and bottom ends 53A, 53B directly engaged to an underside of the top cap 50 and the bottom surface 46 of the base member 42 respectively. This may operate such that the spring member 52 may remain permanently intercalated between the top cap 50 and the base member 42 during tension adjusting procedures. The top end 53A of the spring member 52 may be dynamically abutted against the top cap 50 while the bottom end 53B of the spring member 52 may be statically coupled to the bottom surface 46 of the base member 42. In this manner, the top cap 50 may freely rotate along the top end 53A of the spring member 52 during the tension adjusting procedures. In addition, the base member 42 preferably remains statically situated on the tongue 22 during the tension adjusting procedures. This is advantageous as it may prevent the base member 42 from being pulled in any one direction when the user rotates the cap 50 to add tension to the arms 34 and thereby tighten the footwear 20 to the desired fit.

Figure 4A:
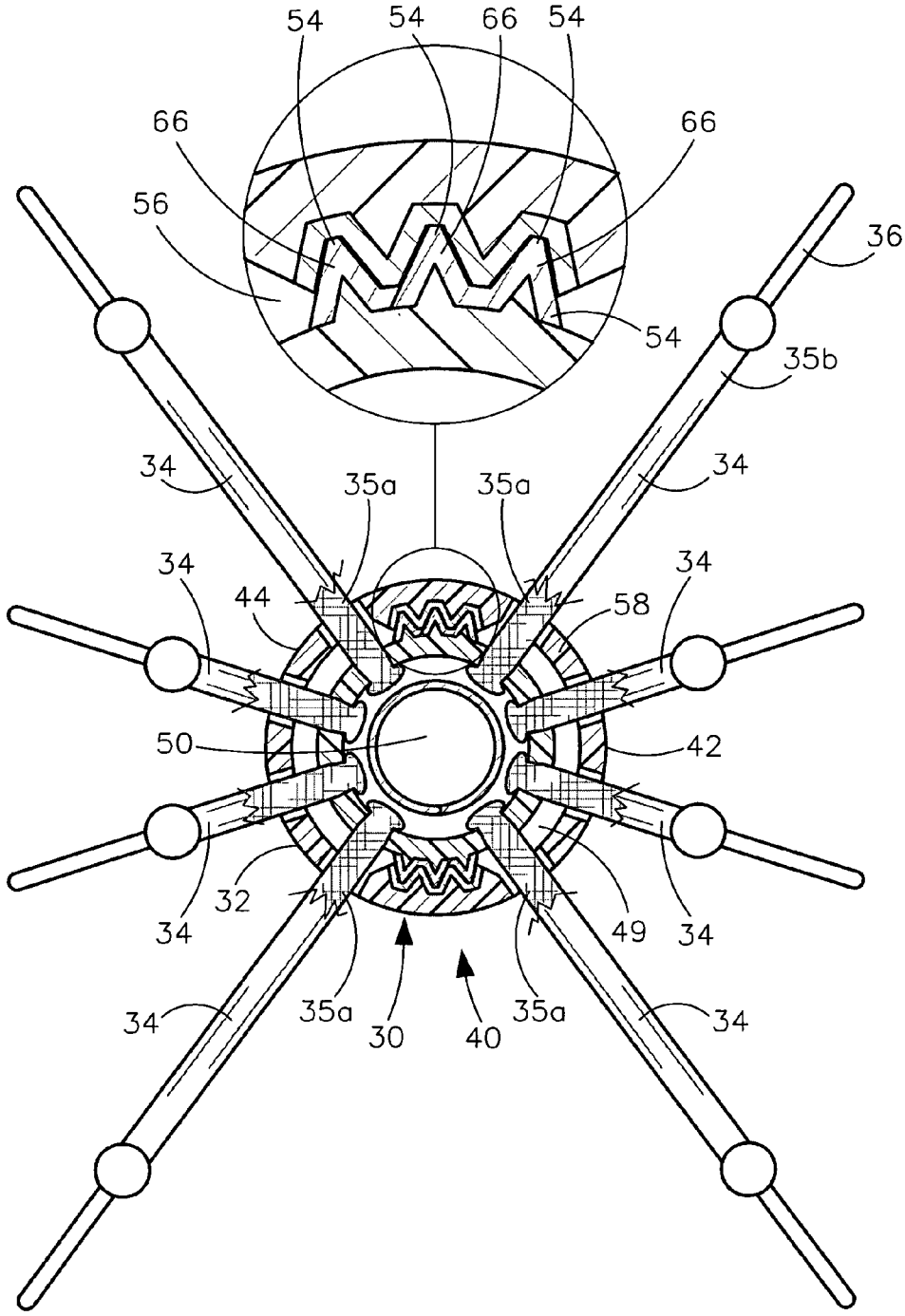
FIG. 4*a* is a cross sectional view of the associated fastening accessory shown in FIG. 3, taken along line 4-4, showing the tension adjusting mechanism in an initial raised position.
Figure 4B:
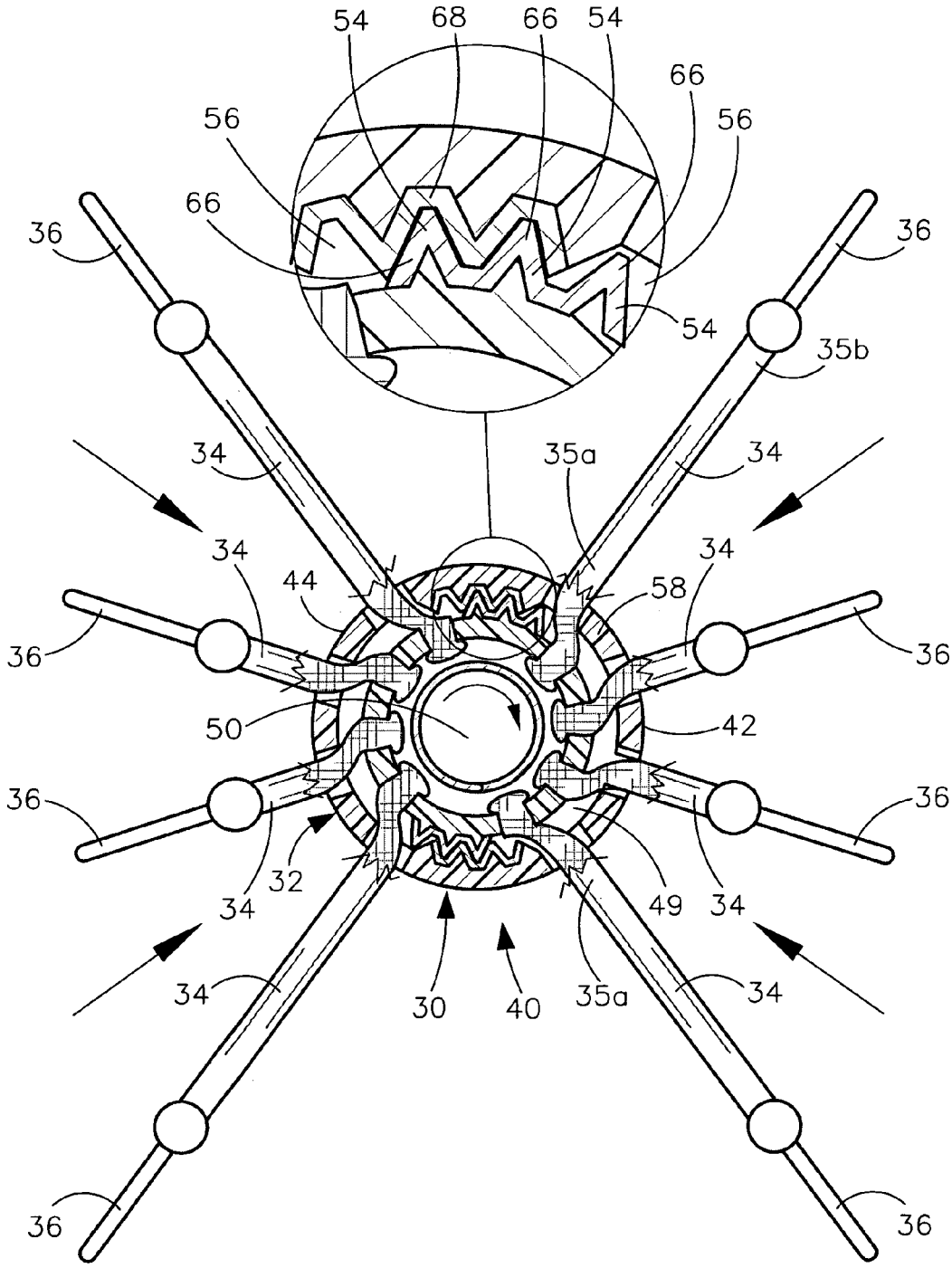
FIG. 4*b* is a cross sectional view of the associated fastening accessory shown in FIG. 3, taken along line 4-4, showing the tension adjusting mechanism in a depressed lowered position and rotated clockwise with the arms tensioned.

Referring now to FIGS. 4*a* and 4*b*, the tension adjusting mechanism 40 may further include a plurality of fingers 54 that may be statically and directly coupled to the top cap 50. The fingers 54 may radially protrude outwardly and away from an outermost perimeter of the top cap 50 and may terminate inwardly of the outer surface of the base member. A plurality of notches 56 may be formed in an inner wall 58 of the outer surface and may be configured in such a manner that the notches 56 may receive the fingers 54 therein when the spring member 52 and the top cap 50 are at corresponding equilibrium and raised positions respectively.

The fingers 54 may be disengaged from the notches 56 when the top cap 50 and the spring member 52 are contemporaneously displaced downward along a linear travel path defined orthogonal to the bottom surface 46 of the base member 42, as perhaps best shown in FIGS. 5*a* and 5*b*. Further, the top cap 50 may be prohibited from rotating along the clockwise and counter-clockwise directions when the top cap 50 is situated at the raised position (as seen in FIG. 4*a*). Additionally, the top cap 50 may be permitted to rotate along clockwise and counter-clockwise directions after the top cap 50 is linearly displaced downwardly along the linear travel path and the spring member 52 is compressed to a tensioned position (as seen in FIG. 4*b*).

Therefore, to operate the mechanism 40, the user may simply depress the top cap 50, releasing the fingers 54 from the notches 56 to permit top cap 50 to be rotated in either direction, thereby tightening or loosening the tension of the fasteners 36 within the apertures 24. Upon reaching a desired tension, the user may release pressure on the cap 50 and allow the spring member 52 to return to equilibrium and the cap 50 to the initial raised position with the fingers 54 resting in alternate notches 56.

Referring again to FIGS. 4*a* and 4*b*, each arm 34 may have a proximal end 35A penetrated through the outer surface of the base member 42 and directly anchored to the top cap 50. The proximal ends 35A may be downwardly displaced from a raised position when the fingers 54 are downwardly displaced away from the notches 56 such that the tension may increase in the arms 34. Further, the proximal ends 35A of the arms 34 may be rotatably displaced along the clockwise and counter-clockwise directions after the top cap 50 is downwardly displaced and rotated along the clockwise and counter-clockwise directions.

In addition, the arms 34 may be maintained at rotatably displaced positions and may thereby be locked at a tensioned position when the top cap 50 is released to the raised position and the fingers 54 re-engage alternate notches 56 respectively. The tension of the arms 34 may be increased when the proximal ends 35A of the arms 34 are shifted to the rotatably displaced positions and maintained within the housing 32 respectively. Thus, by depressing the top cap 50 and moving it along either direction, the user may advantageously adjust the tension of the arms 34 and corresponding tightness of the shoe in relation to the user's foot, and thereby release the top cap 50 to relock the fingers 54 into the notches 56.

Figure 6:
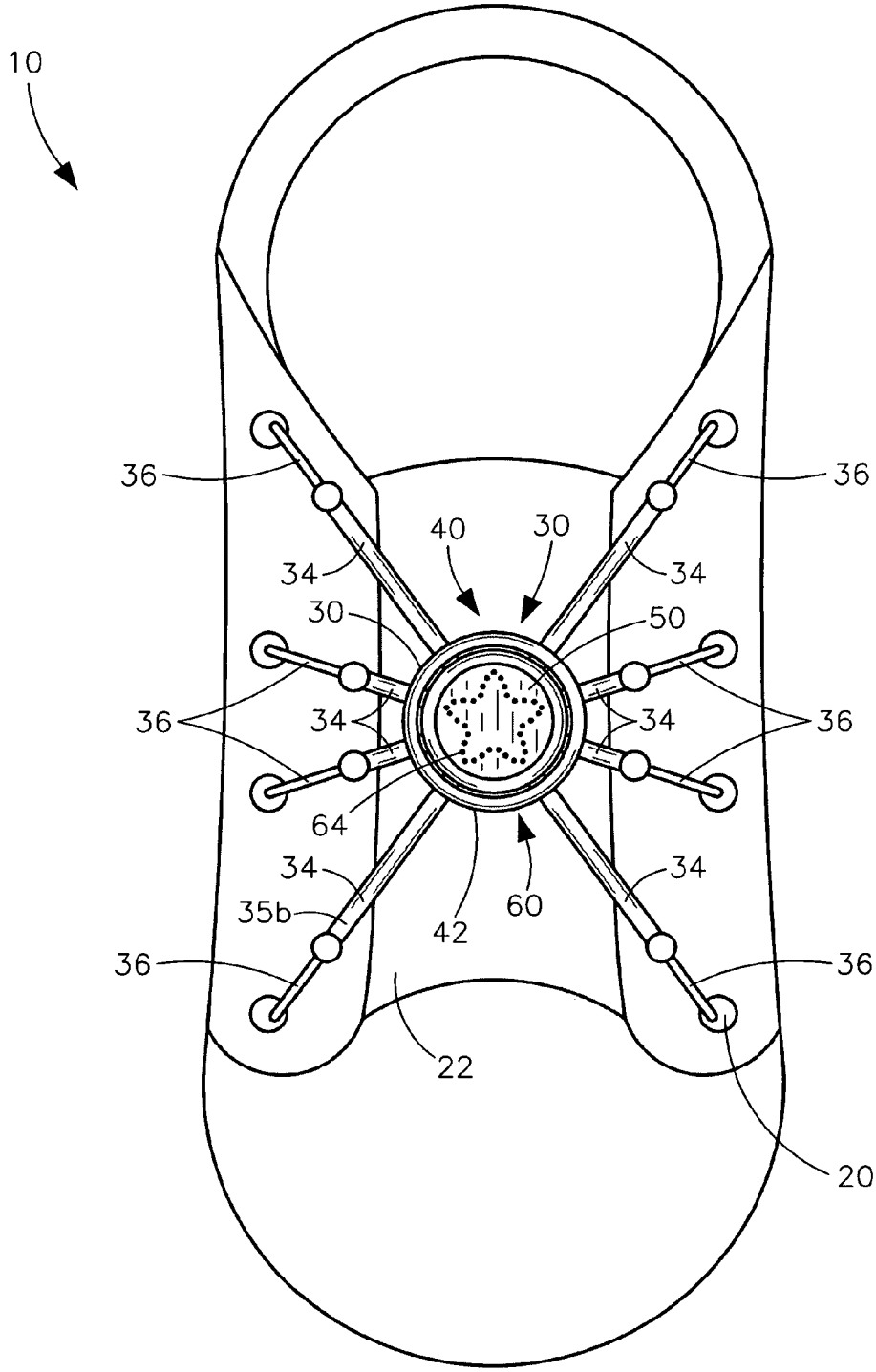
FIG. 6 is a top plan view of the combined footwear and associated fastening accessory shown in FIG. 1.
Figure 7:
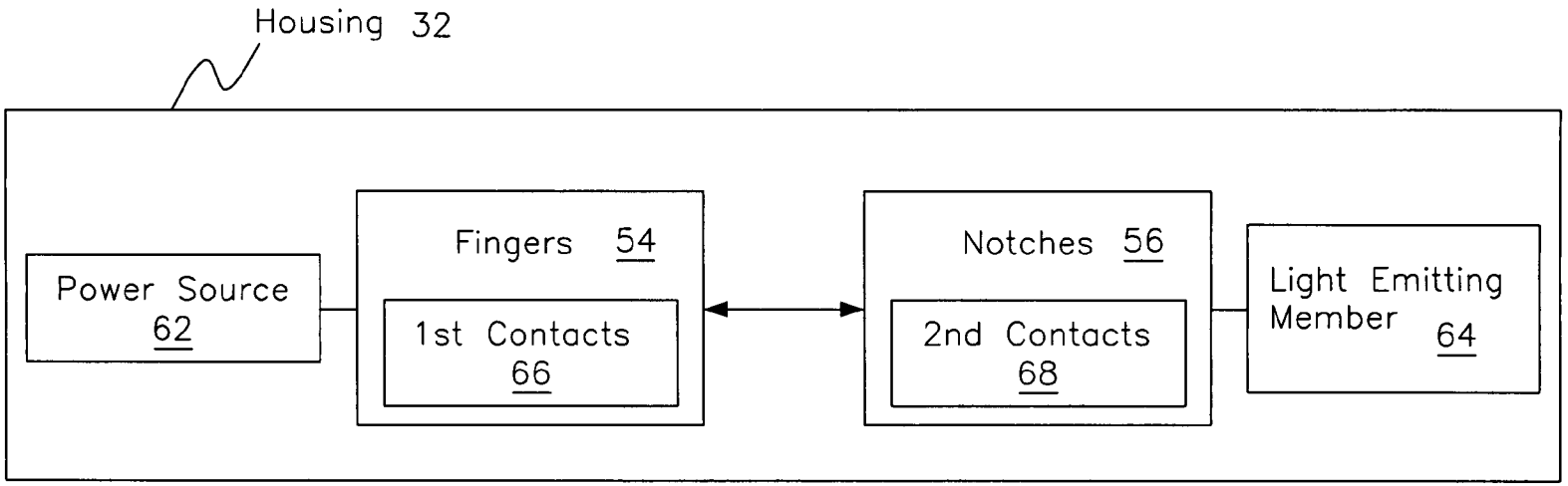
FIG. 7 is a high-level schematic block diagram of the associated fastening accessory shown in FIG. 1, showing the interrelationship between the internal components of the illuminated housing mechanism.

Referring now to FIGS. 6 and 7, the combined footwear and associated fastening accessory 10 may further include a mechanism 60 for illuminating the housing 32 when the top cap 50 is disposed at the raised position such that the housing 32 remains illuminated during walking conditions. Such a mechanism 60 is vital and advantageous for providing a unique and attractive fashion accessory. Additionally, the illumination may be beneficial for safety purposes by warning drivers after dark that the user is walking along the road. The housing illuminating mechanism 60 may include a power source 62 and a light-emitting member 64 seated within the housing 32.

Referring more specifically to FIGS. 4*a*, 4*b*, 5*a*, 5*b* and 7, the mechanism 60 may also include a first plurality of conductive contacts 66 electrically coupled to the fingers 54 and the power source 62 respectively. Also, a second plurality of conductive contacts 68 may be included and electrically coupled to the notches 56 and the light-emitting member 64 respectively. The first conductive contacts 66 may be aligned with corresponding ones of the second conductive contacts 68 when the top cap 50 is in the raised position and the fingers 54 are situated into the corresponding notches 56 respectively. Power may be transmitted from the power source 62 to the light-emitting member 64 when the top cap 50 is released to the raised position and the spring member 52 is adapted to the equilibrium position. In this manner, when the top cap 50 is in the raised position, electrical current is permitted to flow from the power source 62 through the second plurality of conductive contacts 68 to the first plurality of conductive contacts 66 to the light-emitting member 64. This is advantageous in that the light may be illuminated at all times when the cap 50 is in the raised position, thereby signaling to the user that the cap 50 is not locked in place and the arms 34 are not securely tensioned if the light 64 is not illuminated. The combination of such claimed elements provides an unpredictable and unexpected result which is not rendered obvious by one skilled in the art.

Referring to FIGS. 1-7 in general, the present invention 10 may further include a method for employing a combined footwear and associated fastening accessory 10. Such a method may include the chronological steps of first providing footwear 20 that preferably has a tongue 22 and a plurality of apertures 24 formed adjacent to the tongue 22 respectively. Second, the method may include providing and removably coupling a fastening accessory 30 to the footwear by performing a series of steps.

The first step may entail providing and removably seating a housing 32 directly onto the tongue 22 by intermediately spacing the housing 32 between the apertures 24. A second step may include providing and coupling a plurality of deformably resilient elastic arms 34 to the housing 32. A third step may include terminating the arms 34 of the accessory 30 at corresponding ones of the apertures 24 by radially extending the arms 34 away from a center of the housing 32. A fourth step may include providing and mating a plurality of fasteners 36 directly to distal ends 35B of the arms 34 respectively. Thereafter, a fifth step preferably includes prohibiting the housing 32 from disengaging the tongue 22 during walking conditions by removably connecting the fasteners 36 to the apertures 24 and maintaining the housing 32 centrally aligned on the tongue 22. A final step may include selectively adjusting a tension in each of the arms 40 by rotating the housing 32 along clockwise and counter-clockwise directions while maintaining the fasteners 36 directly connected to the apertures 24.

The method in conjunction with the apparatus of the present invention 10, as claimed, provides the unexpected and unpredictable benefit of providing children and young adults with an easy means of tightening their shoes while also providing a fun and fashionable accessory. Users may quickly slip on their shoes, push and twist the top cap 50 of the accessory 30 to tighten the shoes, and then be off on their way. Parents may receive comfort after dark knowing that drivers on the road will see the illumination of the shoes, while kids will be able to select from a wide range of colorful designs and themed accessories to show off to friends at school. These benefits and features of the present invention 10 are not rendered obvious by one skilled in the art.

In an alternate embodiment, the light-emitting member 64 of the accessory 30 may flash or display a sequence of colored lights in an attractive pattern. Further, the accessory 30 may be easily removable and interchangeable, or may be built in and manufactured as a component of common varieties of footwear 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combined footwear and associated fastening accessory for use therewith, said combined footwear and associated fastening accessory comprising:

a footwear having a tongue and a plurality of apertures formed adjacent to said tongue respectively; and a fastening accessory removably coupled to said footwear, said fastening accessory comprising a housing removably seated directly on said tongue while remaining intermediately spaced between said apertures, a plurality of deformably resilient elastic arms coupled to said housing and radially extending away from a center of said housing, a plurality of fasteners directly mated to distal ends of said arms respectively, and means for selectively adjusting a tension in each of said arms by rotating said housing along clockwise and counter clockwise directions while maintaining said fasteners directly connected to said apertures.

2. The combined footwear and associated fastening accessory of claim 1, wherein said housing comprises:

an annular base member having a raised outer wall extending along an entire circumference of said base member, said base member further having a planar bottom surface recessed from a top edge of said outer wall and concentrically seated at a bottom edge of said outer wall such that a cavity is formed above said bottom surface and between said outer surface respectively;

a top cap dynamically situated within said cavity and centrally aligned above said bottom surface; and a deformably resilient spring member having axially opposed top and bottom ends directly engaged to an underside of said top cap and said bottom surface of said base member respectively such that said spring member remains permanently intercalated between said top cap and said base member during tension adjusting procedures;

wherein said top end of said spring member is dynamically abutted against said top cap while said bottom end of said spring member is statically coupled to said bottom surface of said base member such that said top cap freely rotates along said top end of said spring member during said tension adjusting procedures;

wherein said base member remains statically situated on said tongue during said tension adjusting procedures.

3. The combined footwear and associated fastening accessory of claim 2, wherein said tension adjusting means comprises:

a plurality of fingers statically and directly coupled to said top cap, said fingers radially protruding outwardly and away from an outermost perimeter of said top cap and terminating inwardly of said outer surface of said base member;

a plurality of notches formed in an inner wall of said outer surface and being configured in such a manner that said notches receive said fingers therein when said spring member and said top cap are at corresponding equilibrium and raised positions respectively;

wherein said fingers are disengaged from said notches when said top cap and said spring member are contemporaneously displaced downward along a linear travel path defined orthogonal to said bottom surface of said base member.

4. The combined footwear and associated fastening accessory of claim 3, wherein each of said arms has a proximal end penetrated through said outer surface of said base member and directly anchored to said top cap, said proximal ends being downwardly displaced from a raised position when said fingers are downwardly displaced away from said notches such that said tension increases in said arms.

5. The combined footwear and associated fastening accessory of claim 4, wherein said top cap is prohibited from rotating along the clockwise and counter clockwise directions when said top cap is situated at the raised position;

wherein said top cap is permitted to rotate along the clockwise and counter clockwise directions after said top cap is linearly displaced downwardly along the linear travel path such that said spring member becomes compressed to a tensioned position.

6. The combined footwear and associated fastening accessory of claim 5, wherein said proximal ends of said arms are rotatably displaced along the clockwise and counter clockwise directions after said top cap is downwardly displaced and rotated along the clockwise and counter clockwise directions, said arms being maintained at rotatably displaced positions and thereby locked at a tensioned position when said top cap is released to the raised position and said fingers reengage said notches respectively.

7. The combined footwear and associated fastening accessory of claim 6, wherein said tension of said arms is increased when said proximal ends of said arms are shifted to the rotatably displaced positions and maintained within said housing respectively.

8. The combined footwear and associated fastening accessory of claim 3, further comprising:

means for illuminating said housing when said top cap is disposed at said raised position such that said housing remains illuminated during walking conditions.

9. The combined footwear and associated fastening accessory of claim 8, wherein said housing illuminating means comprises:

a power source seated within said housing;

a light-emitting member seated within said housing;

a first plurality of conductive contacts electrically coupled to said fingers and light-emitting member respectively; and a second plurality of conductive contacts electrically coupled to said notches and said power source respectively, said second conductive contacts being aligned with corresponding ones of said first conductive contacts when said top cap is released to said raised position and said fingers are situated into said corresponding notches respectively;

wherein power is transmitted from said power source to said light-emitting member when said top cap is released to said raised position and said spring member is adapted to the equilibrium position.

10. A combined footwear and associated fastening accessory for use therewith, said combined footwear and associated fastening accessory comprising:

a footwear having a tongue and a plurality of apertures formed adjacent to said tongue respectively; and a fastening accessory removably coupled to said footwear, said fastening accessory comprising a housing removably seated directly on said tongue while remaining intermediately spaced between said apertures, a plurality of deformably resilient elastic arms coupled to said housing and radially extending away from a center of said housing, said arms terminating at corresponding ones of said apertures respectively, a plurality of fasteners directly mated to distal ends of said arms respectively, said fasteners being removably connected to said apertures such that said housing remains centrally aligned on said tongue and thereby prohibited from disengaging said tongue during walking conditions, and means for selectively adjusting a tension in each of said arms by rotating said housing along clockwise and counter clockwise directions while maintaining said fasteners directly connected to said apertures.

11. The combined footwear and associated fastening accessory of claim 10, wherein said housing comprises:

an annular base member having a raised outer wall extending along an entire circumference of said base member, said base member further having a planar bottom surface recessed from a top edge of said outer wall and concentrically seated at a bottom edge of said outer water such that a cavity is formed above said bottom surface and between said outer surface respectively;

a top cap dynamically situated within said cavity and centrally aligned above said bottom surface; and a deformably resilient spring member having axially opposed top and bottom ends directly engaged to an underside of said top cap and said bottom surface of said base member respectively such that said spring member remains permanently intercalated between said top cap and said base member during tension adjusting procedures;

wherein said top end of said spring member is dynamically abutted against said top cap while said bottom end of said spring member is statically coupled to said bottom surface of said base member such that said top cap freely rotates along said top end of said spring member during said tension adjusting procedures;

wherein said base member remains statically situated on said tongue during said tension adjusting procedures.

12. The combined footwear and associated fastening accessory of claim 11, wherein said tension adjusting means comprises:

a plurality of fingers statically and directly coupled to said top cap, said fingers radially protruding outwardly and away from an outermost perimeter of said top cap and terminating inwardly of said outer surface of said base member;

a plurality of notches formed in an inner wall of said outer surface and being configured in such a manner that said notches receive said fingers therein when said spring member and said top cap are at corresponding equilibrium and raised positions respectively;

wherein said fingers are disengaged from said notches when said top cap and said spring member are contemporaneously displaced downward along a linear travel path defined orthogonal to said bottom surface of said base member.

13. The combined footwear and associated fastening accessory of claim 12, wherein each of said arms has a proximal end penetrated through said outer surface of said base member and directly anchored to said top cap, said proximal ends being downwardly displaced from a raised position when said fingers are downwardly displaced away from said notches such that said tension increases in said arms.

14. The combined footwear and associated fastening accessory of claim 13, wherein said top cap is prohibited from rotating along the clockwise and counter clockwise directions when said top cap is situated at the raised position;

wherein said top cap is permitted to rotate along the clockwise and counter clockwise directions after said top cap is linearly displaced downwardly along the linear travel path such that said spring member becomes compressed to a tensioned position.

15. The combined footwear and associated fastening accessory of claim 14, wherein said proximal ends of said arms are rotatably displaced along the clockwise and counter clockwise directions after said top cap is downwardly displaced and rotated along the clockwise and counter clockwise directions, said arms being maintained at rotatably displaced positions and thereby locked at a tensioned position when said top tap is released to the raised position and said fingers re-engage said notches respectively.

16. The combined footwear and associated fastening accessory of claim 15, wherein said tension of said arms is increased when said proximal ends of said arms are shifted to the rotatably displaced positions and maintained within said housing respectively.

17. The combined footwear and associated fastening accessory of claim 12, further comprising:

means for illuminating said housing when said top cap is disposed at said raised position such that said housing remains illuminated during walking conditions.

18. The combined footwear and associated fastening accessory of claim 17, wherein said housing illuminating means comprises:

a power source seated within said housing;

a light-emitting member seated within said housing;

a first plurality of conductive contacts electrically coupled to said fingers and said light emitting member respectively; and a second plurality of conductive contacts electrically coupled to said notches and said power source respectively, said second conductive contacts being aligned with corresponding ones of said first conductive contacts when said top cap is released to said raised position and said fingers are situated into said corresponding notches respectively;

wherein power is transmitted from said power source to said light-emitting member when said top cap is released to said raised position and said spring member is adapted to the equilibrium position.

19. A method for employing a combined footwear and associated fastening accessory, said method comprising the chronological steps of:

a. providing a footwear having a tongue and a plurality of apertures formed adjacent to said tongue respectively; and b. providing and removably coupling a fastening accessory to said footwear by performing the following steps i. providing and removably seating a housing directly on said tongue by intermediately spacing said housing between said apertures, ii. providing and coupling a plurality of deformably resilient elastic arms to said housing, iii. terminating said arms at corresponding ones of said apertures by radially extending said arms away from a center of said housing, iv. providing and mating a plurality of fasteners directly to distal ends of said arms respectively;

v. prohibiting said housing from disengaging said tongue during walking conditions by removably connecting said fasteners to said apertures and maintaining said housing centrally aligned on said tongue, and vi. selectively adjusting a tension in each of said arms by rotating said housing along clockwise and counter clockwise directions while maintaining said fasteners directly connected to said apertures.

* * * * *